US006381788B2

(12) United States Patent
Wu

(10) Patent No.: US 6,381,788 B2
(45) Date of Patent: May 7, 2002

(54) NAILING TOOL CAPABLE OF INITIALLY STARTING A CONNECTING MEMBER WITH A TIP

(76) Inventor: Shu Te Wu, No. 6, Lane 176, Wu Fu road, Wu Feng, Taichung (TW)

( * ) Notice: Subject to any disclaimer, the term of this patent is extended or adjusted under 35 U.S.C. 154(b) by 0 days.

(21) Appl. No.: 09/797,870

(22) Filed: Mar. 5, 2001

(30) Foreign Application Priority Data

Aug. 14, 2000 (TW) ..... 89214161 U

(51) Int. Cl.[7] ..... B25D 1/04
(52) U.S. Cl. ..... 7/143; 81/44
(58) Field of Search ..... 7/143; 81/44, 20, 81/23, 27

(56) References Cited

U.S. PATENT DOCUMENTS 623,792 A * 4/1899 Lans ..... 81/20
1,572,046 A * 2/1926 Seiler ..... 81/44
3,010,193 A * 11/1961 Croall, Jr. et al. ..... 81/463
3,789,895 A * 2/1974 Levinson ..... 81/44
3,847,193 A * 11/1974 Brunstetter ..... 81/44
4,268,927 A * 5/1981 Bridwell ..... 81/20
5,826,969 A * 10/1998 Nevin ..... 362/120
5,921,456 A * 7/1999 Kirsch et al. ..... 81/44
5,970,553 A * 10/1999 Lin ..... 7/143

* cited by examiner

*Primary Examiner*—James G. Smith
*Assistant Examiner*—Hadi Shakeri
(74) *Attorney, Agent, or Firm*—Browdy and Neimark, P.L.L.C.

(57) ABSTRACT

Nailing tool capable of intially starting a connecting member with a tip, including: a stem body; a striking member, a top end of the striking member being formed with a cavity, the striking member being fitted in an axial tunnel of the stem body and slidable along the tunnel; a resilient member disposed between the striking member and the stem body, when not subject to external force, the resilient member keeping forcing the striking member upward; a pull member connected with the striking member for an operator's hand to operate so as to drive the striking member toward the bottom end of the stem body; and a press button pivotally connected with the stem body. When the, striking member is moved downward, the press button latches the striking member at a position ready for striking. When the press button is pressed, the striking member is unlatched and resiliently bounded by the resilient member toward the top end of the stem body. By means of the striking force of the striking member, the tip off the connecting member loaded in the cavity is nailed into a work piece.

21 Claims, 17 Drawing Sheets

NAILING TOOL CAPABLE OF INITIALLY STARTING A CONNECTING MEMBER WITH A TIP

BACKGROUND OF THE INVENTION

The present invention is related to a nailing tool capable of initially starting a connecting member with a tip, such as a nail or a self-tapping screw, into a work piece to facilitate succeeding work.

A sharp connecting member such as a nail or a self-tapping screw is used to connect two work pieces. When striking a nail into a work piece with a hammer, an operator must pinch the nail with one hand and hold the hammer with the other hand for hammering the nail. After the tip of the nail is nailed into the surface of the work piece, the operator can release the nail and directly totally hammer the nail into the work piece with the hammer. During such operation, it often takes place that the operator fails to strike the nail and instead strikes the hand pinching the nail. This often results in injury of the hand, especially in those working sites hard for the operator to strike the nail in correct angle, such as a narrow space or a ceiling.

A screwdriver is used to press a self-tapping screw against a work piece and screw it into the work piece. When the tip of the self-tapping screw is not yet thrust into the work piece, during turning the self-tapping screw, it often takes place that the self-tapping screw slips away or bound out. Therefore, such operation is inconvenient and dangerous.

SUMMARY OF THE INVENTION

It is therefore a primary object of the present invention to provide a nailing tool capable of initially starting a connecting member with a tip. The nailing tool enables an operator to initially start the connecting member such as a nail or a self-tapping screw into a work piece to facilitate succeeding work and protect the operator from being injured in operation.

The present invention can be best understood through the following description and accompanying drawings wherein:

DETAILED DESCRIPTION OF THE PREFERRED EMBODIMENTS

Figure 1:
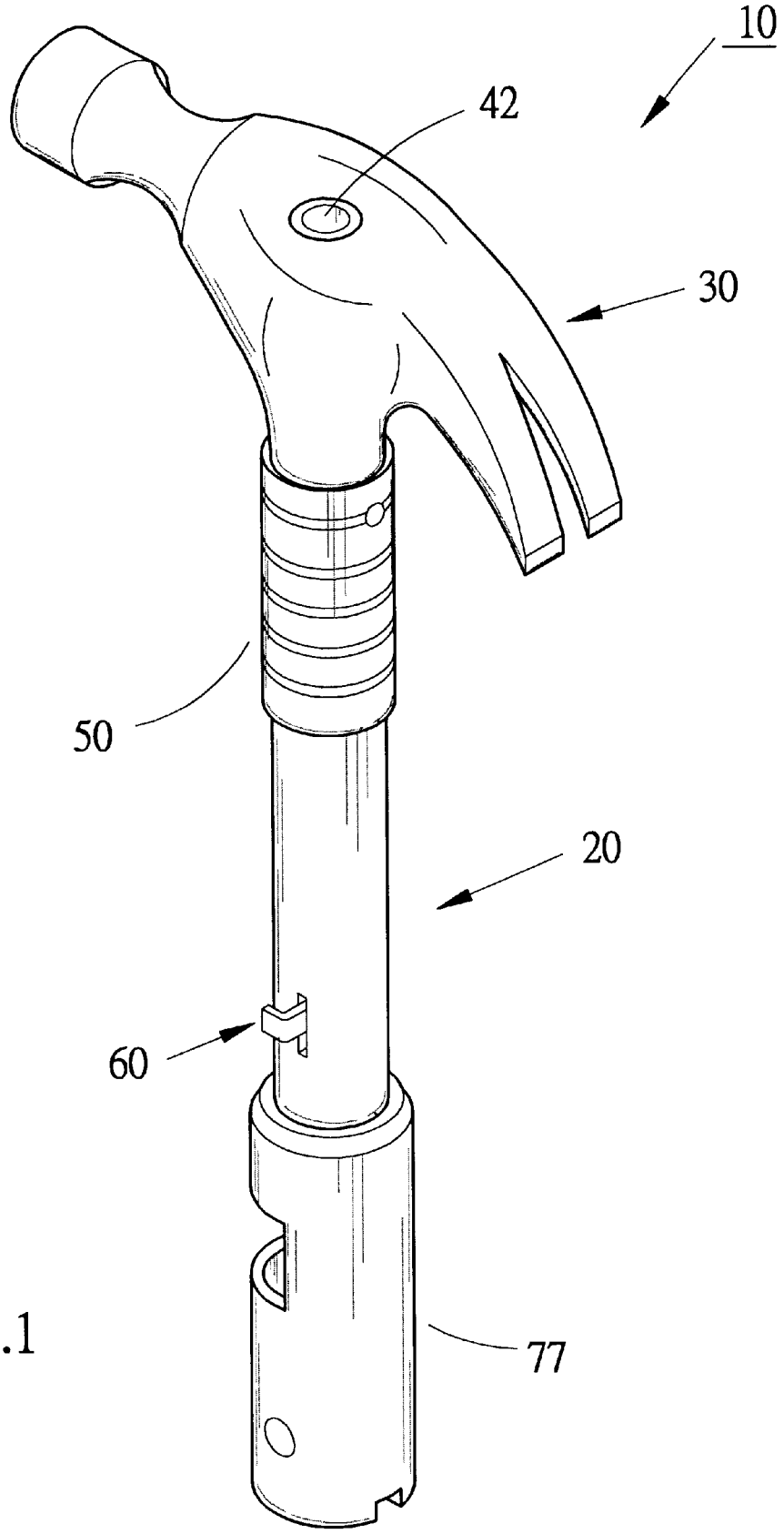
FIG. 1 is a perspective assembled view of a preferred embodiment of the present invention.
Figure 2:
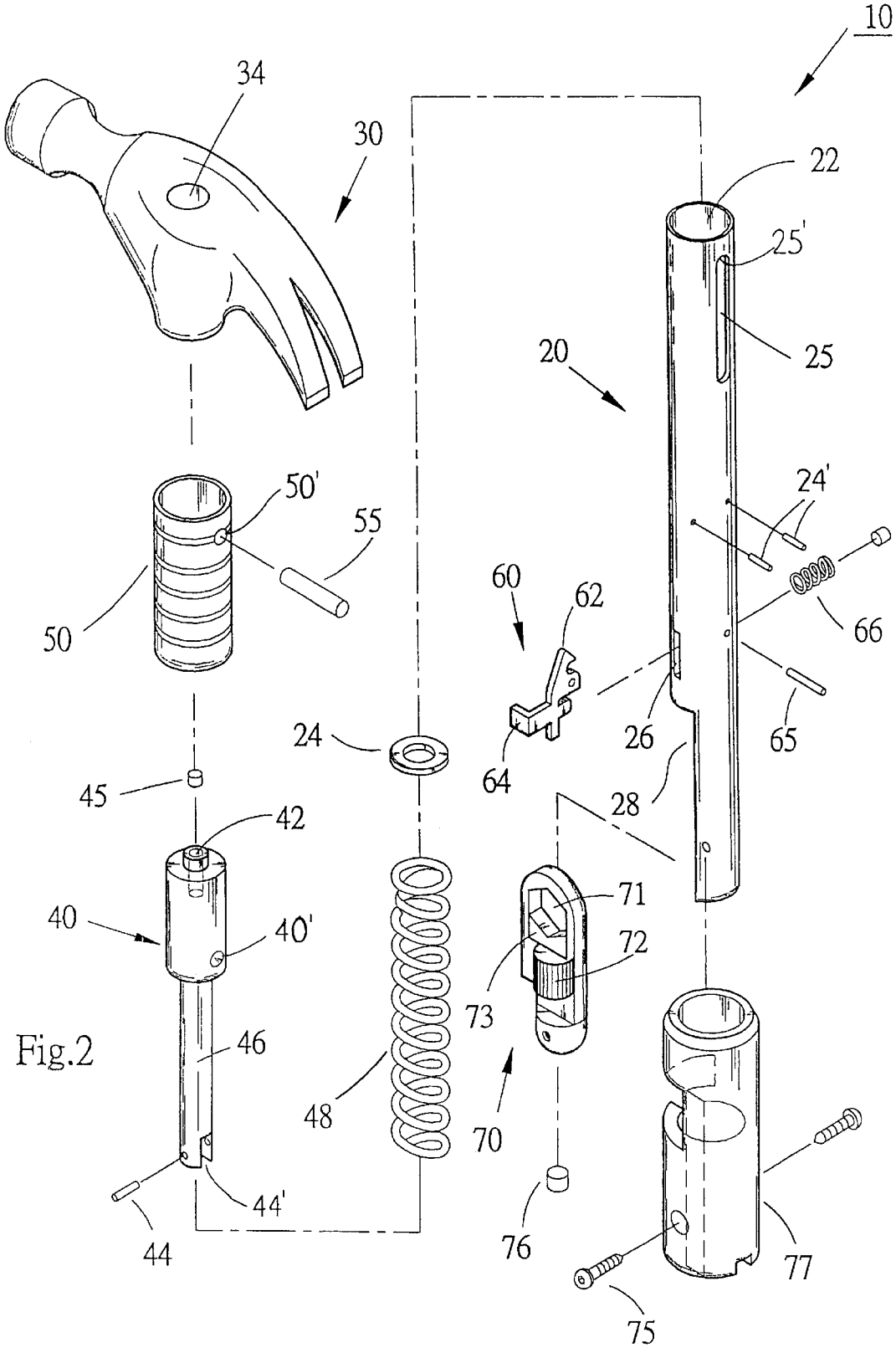
FIG. 2 is a perspective exploded view according to FIG. 1.

Please refer to FIGS. 1 and 2. According to a first embodiment, the nailing tool 10 of the present invention has a form of a hammer having the following elements.

A stem body 20 formed with an internal axial tunnel 22 passing through a top end of the stem body.

Figure 3:
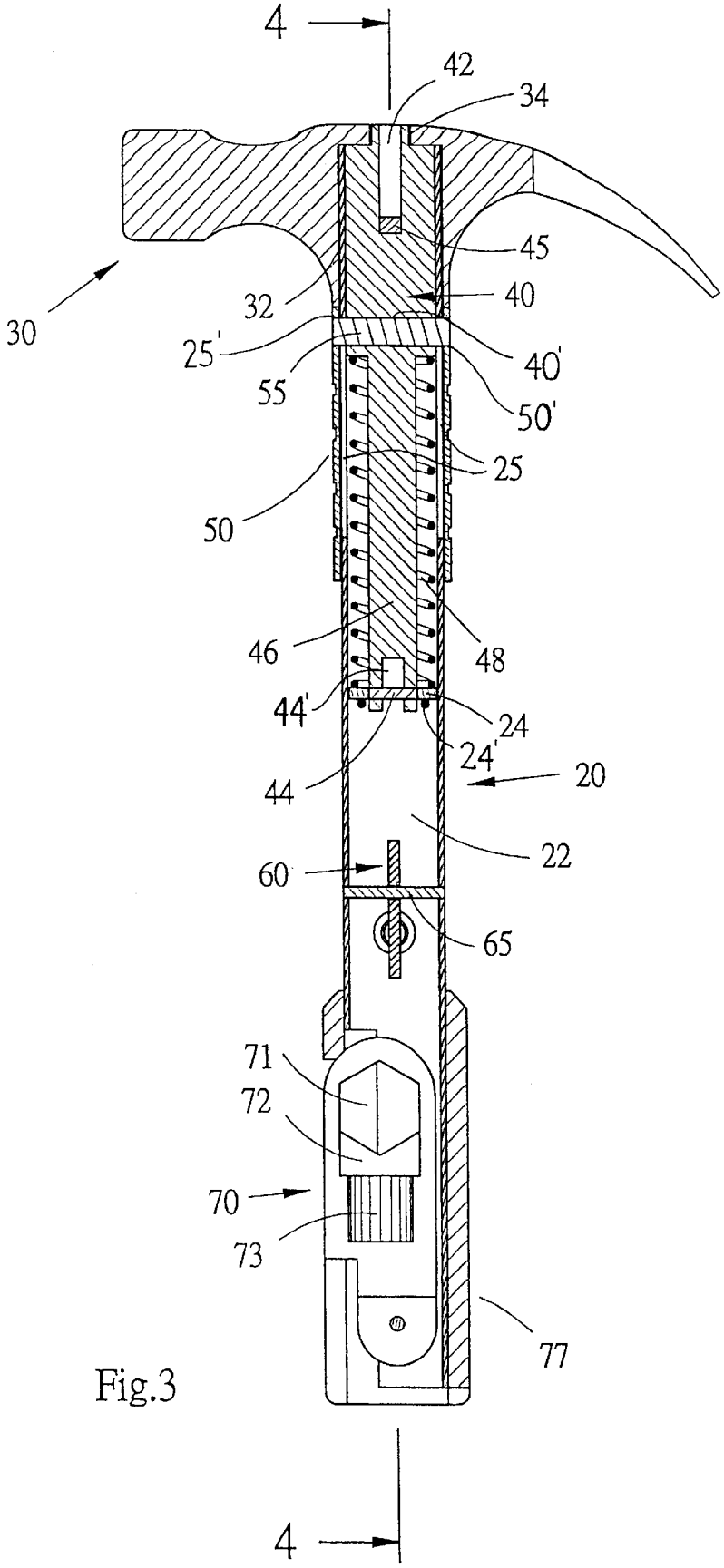
FIG. 3 is a longitudinal sectional view according to FIG. 1.

A head body 30 with a fitting hole 32 as shown in FIG. 3, in which the top end of the stem body 20 is fixedly fitted, a top end of the head body 30 being formed with a through hole 34 through which the tunnel 22 of the stem body communicates to the outside of the nailing tool 10.

A striking member 40 which is an elongated body, a top end of the striking member 40 being formed with a cavity 42, a bottom end of the striking member 40 being provided with a hooking section 44 formed by a pin through the bottom end of the striking member 40 bridging slot 44' extending to the outer circumference of the bottom end of the striking member. A locating member 45 such as a magnet is installed in the cavity 42. The striking member 40 is axially slidably fitted in the tunnel 22 of the stem body 20. A resilient member 48 is fitted around a smaller diameter section 46 of the striking member, one end of the resilient member 48 being held against the striking member 40, while the other end thereof is held against a retaining section 24 engaged on top of pins 24' fixed on the inner wall of the tunnel 22, whereby when not subject to external force, the resilient member 48 forces the striking member upward so that the cavity 42 is exposed to the outside of head body 30 at the through hole 34 of the head body.

Figure 4:
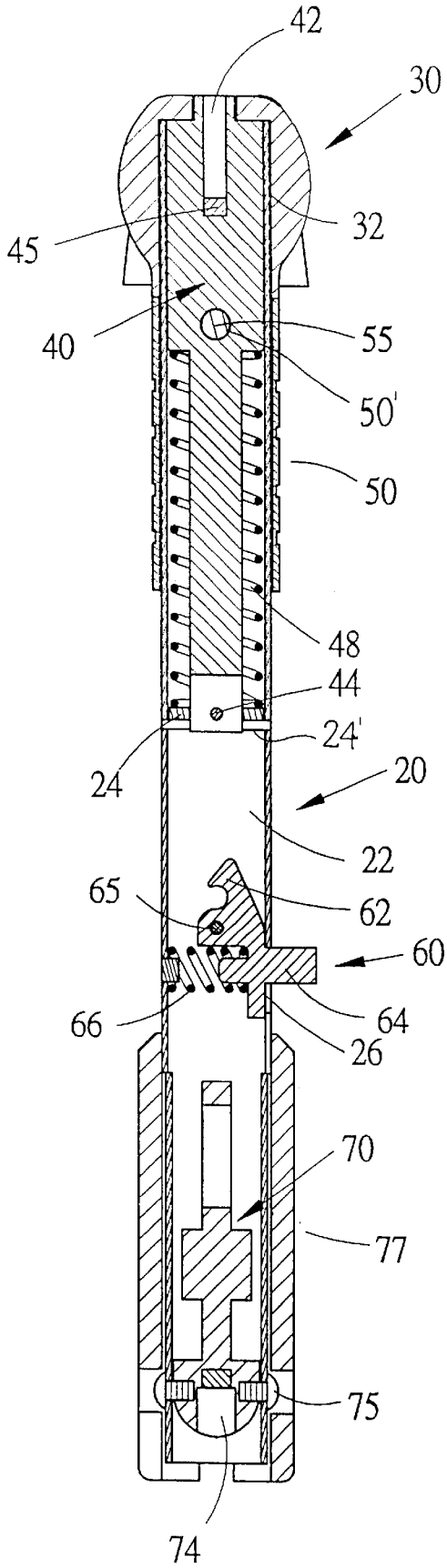
FIG. 4 is a sectional view taken along line 4—4 of FIG. 3.
Figure 6:
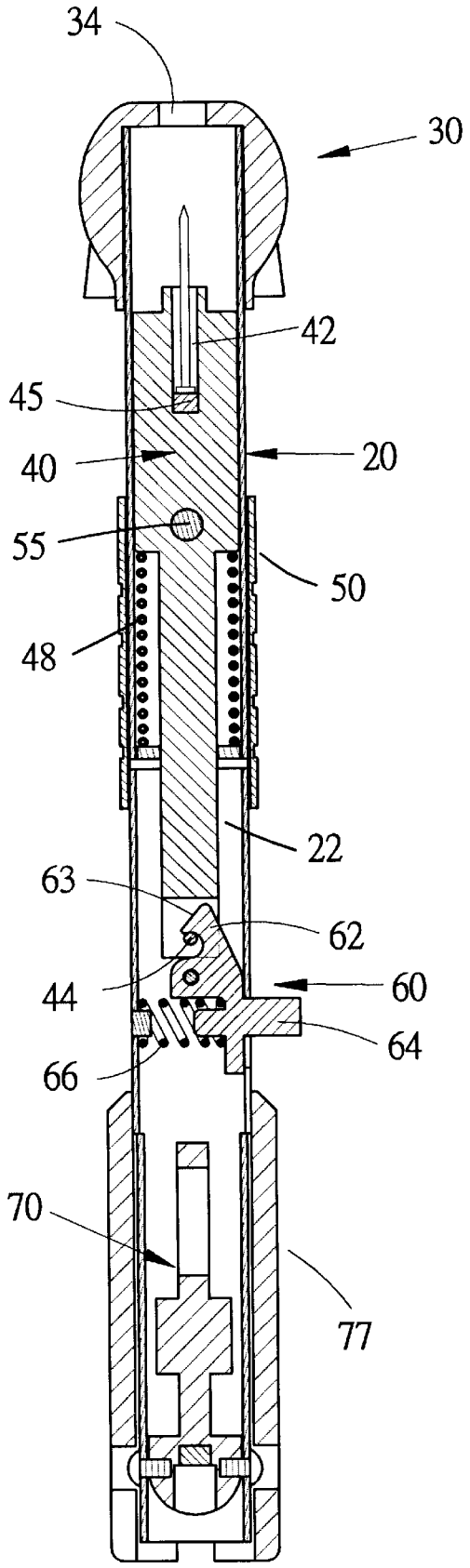
FIG. 6 is a longitudinal sectional view showing that the nail is ready for striking.

As shown in FIGS. 3, 4 and 6 a pull member 50 which is a tube body in this embodiment is slidably fitted around the stem body 20. A pin member 55 which transversely passes through a hole 40' in the striking member 40 and two opposing axially guide slots 25 formed on the stem body 20 is fixed in holes 50' in pull member 50. Thus, when an operator pulls the pull member down, as shown in FIG. 6, the striking member is synchronously driven and moved downward so that hooking section 44 is engaged on latch hook section 62, When the striking member 40 is released as described below, it is resiliently pushed upward by the resilient member 49 until the pin member 55 abuts against top ends 25' of the two guide slots 25, which serve as stops for the striking member. Alternatively, the top end of the striking member can abut against the head body 30 to serve as a stop.

A press button 60 on the latch hook section 62 has a press section 64, the press button 60 is pivotally connected with the stem body 20 by an insertion pin 65 as shown in FIGS. 3 and 4. The latch hook section 62 is positioned in the tunnel 22, while the press section 64 extends out of the stem body through a slit 26 thereof for an operator's hand to press. A resilient member 66 is positioned between the stem body 20 and the press button 60 with one end abutting against the inner wall of the stem body and with the other end abutting against the press button, whereby when not subject to external force, the latch hook section 62 is kept in a latched state.

A wrench member 70, one end of the wrench member 70 being formed with an-opening 71 for wrenching a nut, a rotary button 72 being rotatably disposed on the wrench member for sliding a slide block 73 up and down so as to change the size of the opening 71. Such opening structure 71 pertains to prior art and will not be further described. The other end of the wrench member 70 is formed with a hexagonal socket 74 as shown in FIG. 4. The wrench member 70 is pivotally connected with bottom end of the stem body 20 by two screw members 75 and received in a recess 28 of the bottom end of the stem body. A sleeve member 77 is fitted around the bottom end of the stem body 20 to enclose the wrench member 70.

Figure 5:
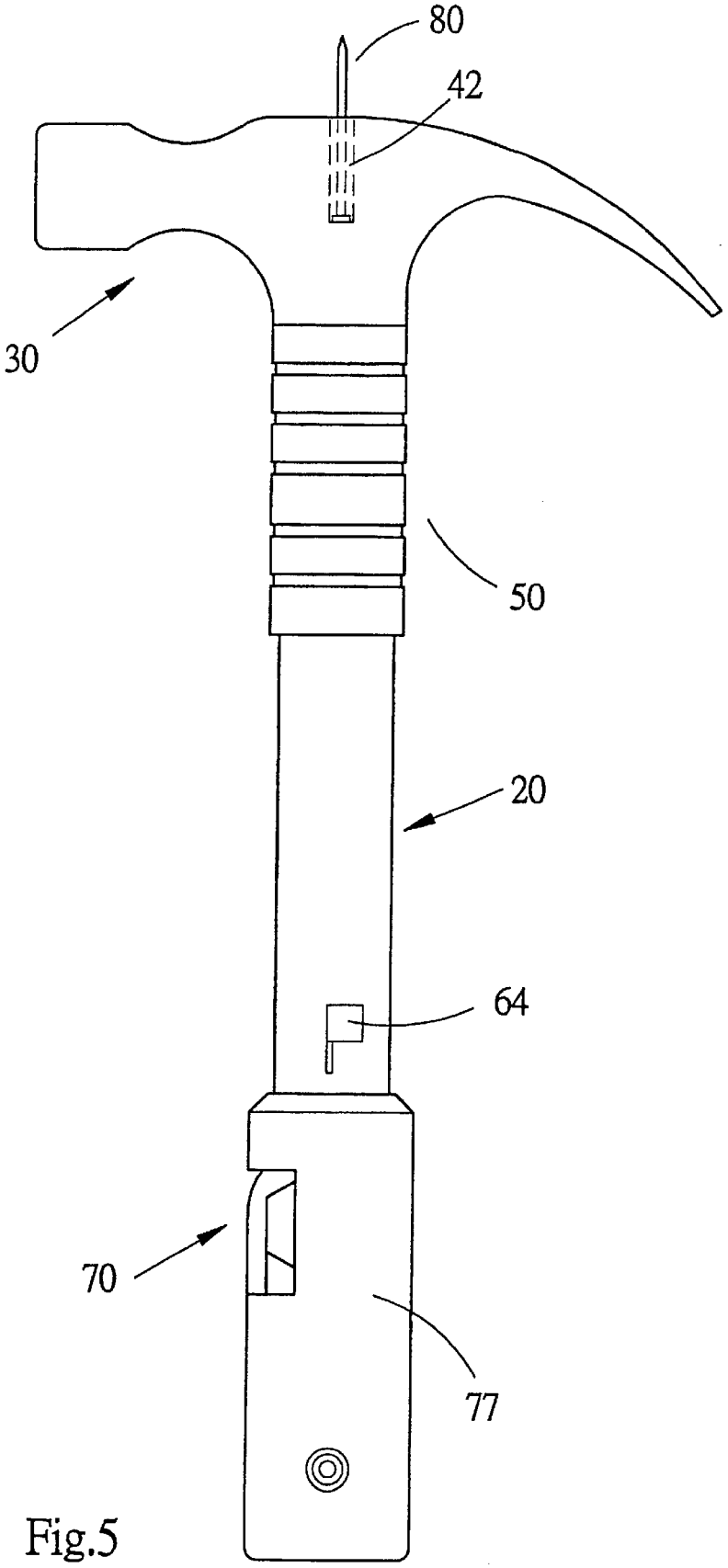
FIG. 5 shows that a nail is loaded into the nailing tool.

In use of the present invention, as shown in FIG. 5, a nail 80 is first placed into the cavity 42 of the striking member 40 with the head section of the nail retained by the locating member in the cavity, that is, attracted by the magnet 45. Then the pull member 50 is pulled toward the bottom end of the stem body 20. At this time, the striking member 40 is synchronously moved downward as shown in FIG. 6. When the hooking section 44 of the striking member first engages the press button 60, the hooking section 44 pushes against a slope 63 of the latch hook section 62 to outward bias the latch hook section 62. After the hooking section 44 moves further downward and leaves the slope 63, the latch hook section 62 latches the hooking section 44, whereby the striking member 40 is placed at a position ready for striking. Under such circumstance, the resilient member 48 is compressed to reserve an elastic energy.

Figure 7:
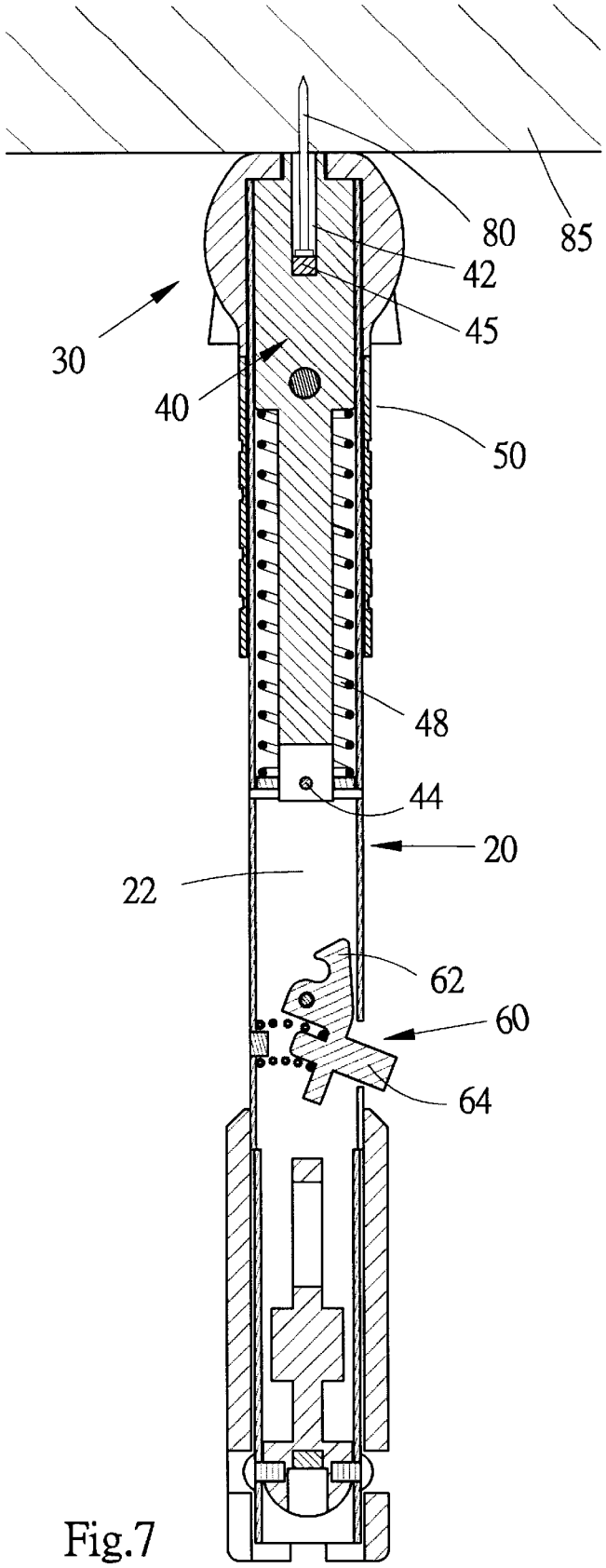
FIG. 7 is a longitudinal sectional view showing that the nail is initially started into a work piece.
Figure 8:
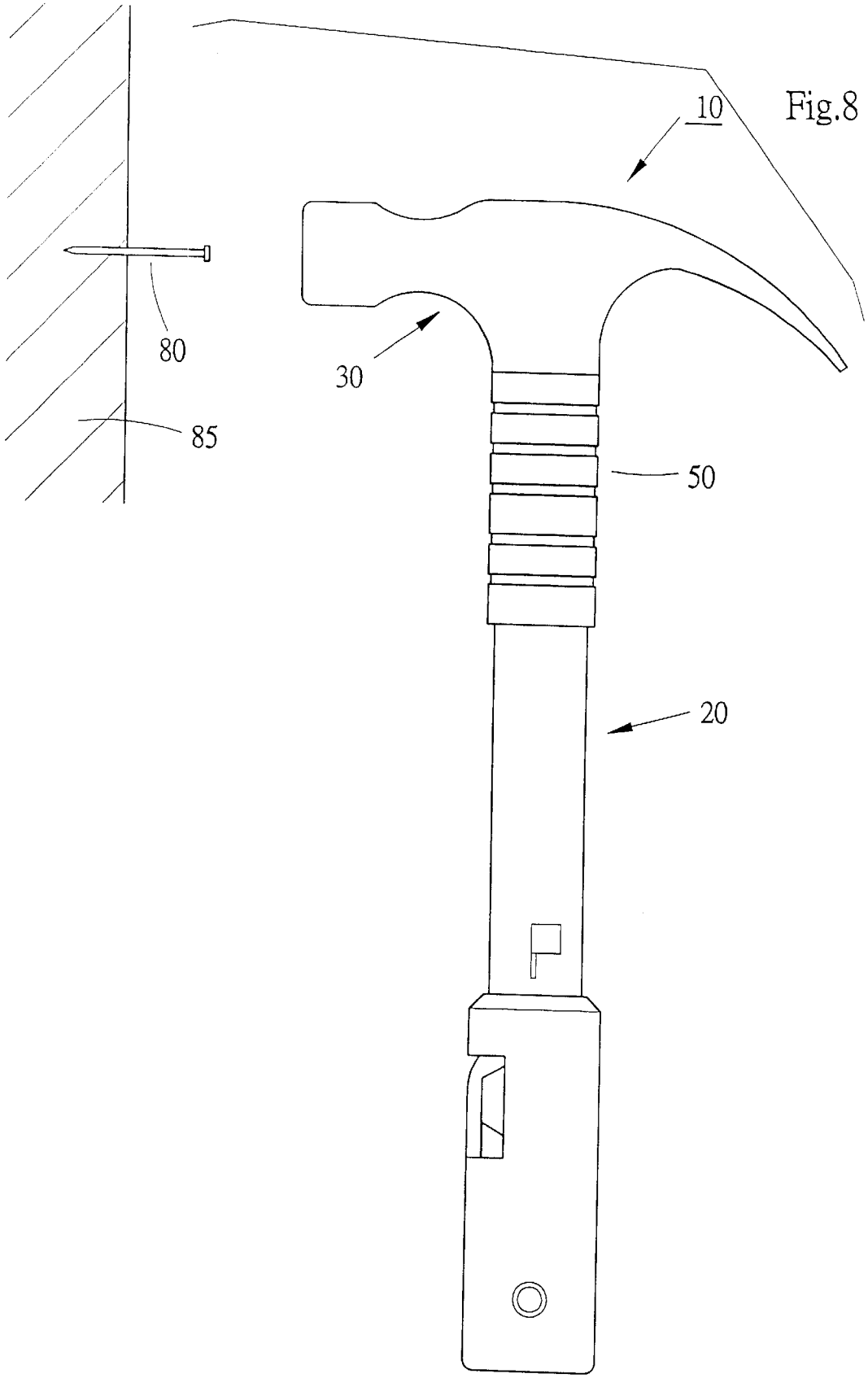
FIG. 8 shows that the nail of FIG. 7 is further hammered into the work piece.

When the top end of the stem body 20 is held against a work piece 85 and the press button 60 is pressed and biased to a releasing position. The hooking section 44 is unlatched from the latch hook section 62 and the striking member 40 is resiliently forced by the resilient member 48 toward the top end of the stem body. Accordingly, the tip of the nail 80 is nailed into the work piece 85 as shown in FIG. 7. Thereafter, the operator can separate the nail from nailing tool 10 and hammer the nail into the work piece 85 with the head body 30 as shown in FIG. 8.

Figure 9:
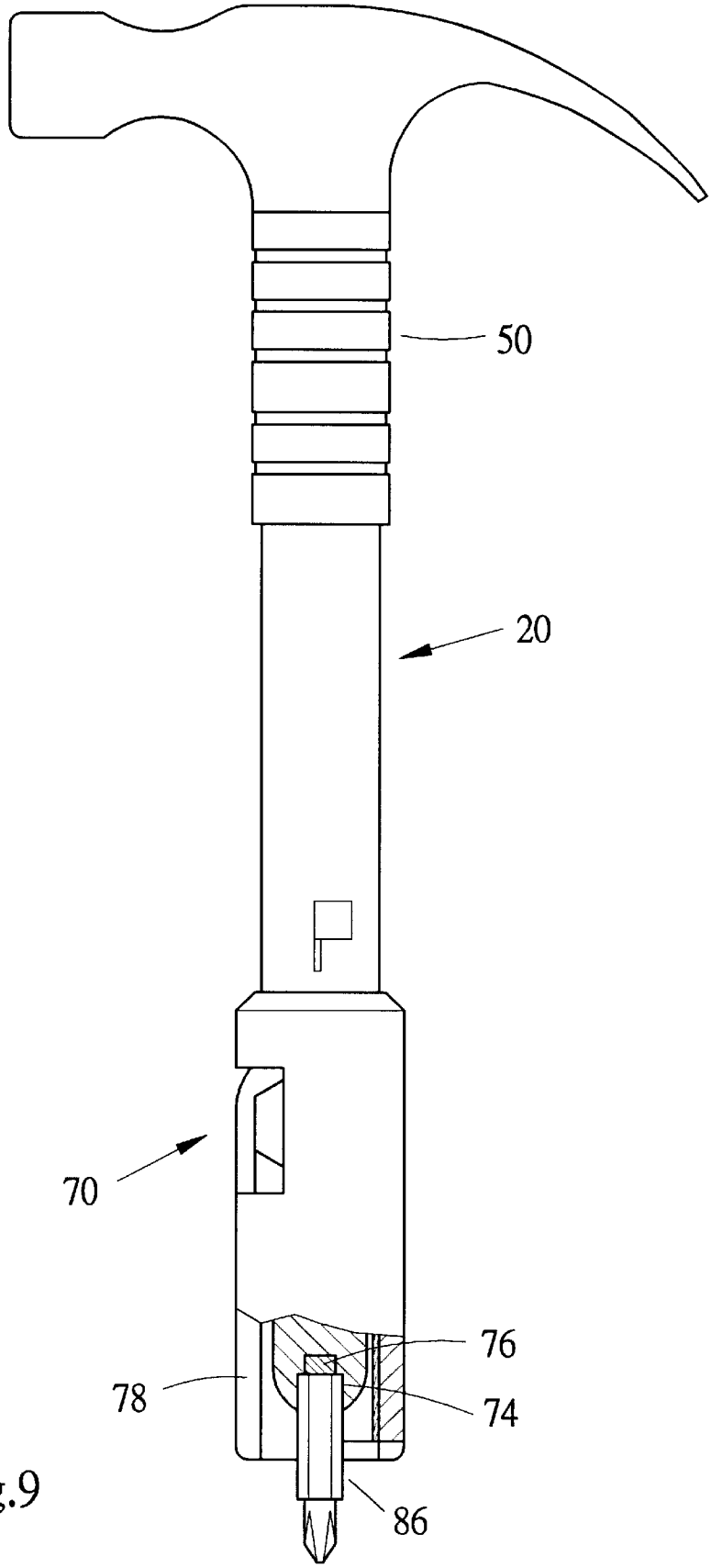
FIG. 9 shows that the nailing tool is alternatively used as a screwdriver.

As shown in FIG. 9, a screwdriver bit 86 can be inserted into the socket 74 of the wrench member 70 and attracted by a second magnet 76 disposed in the socket. Therefore, the present invention can be also used as a screwdriver.

Figure 10:
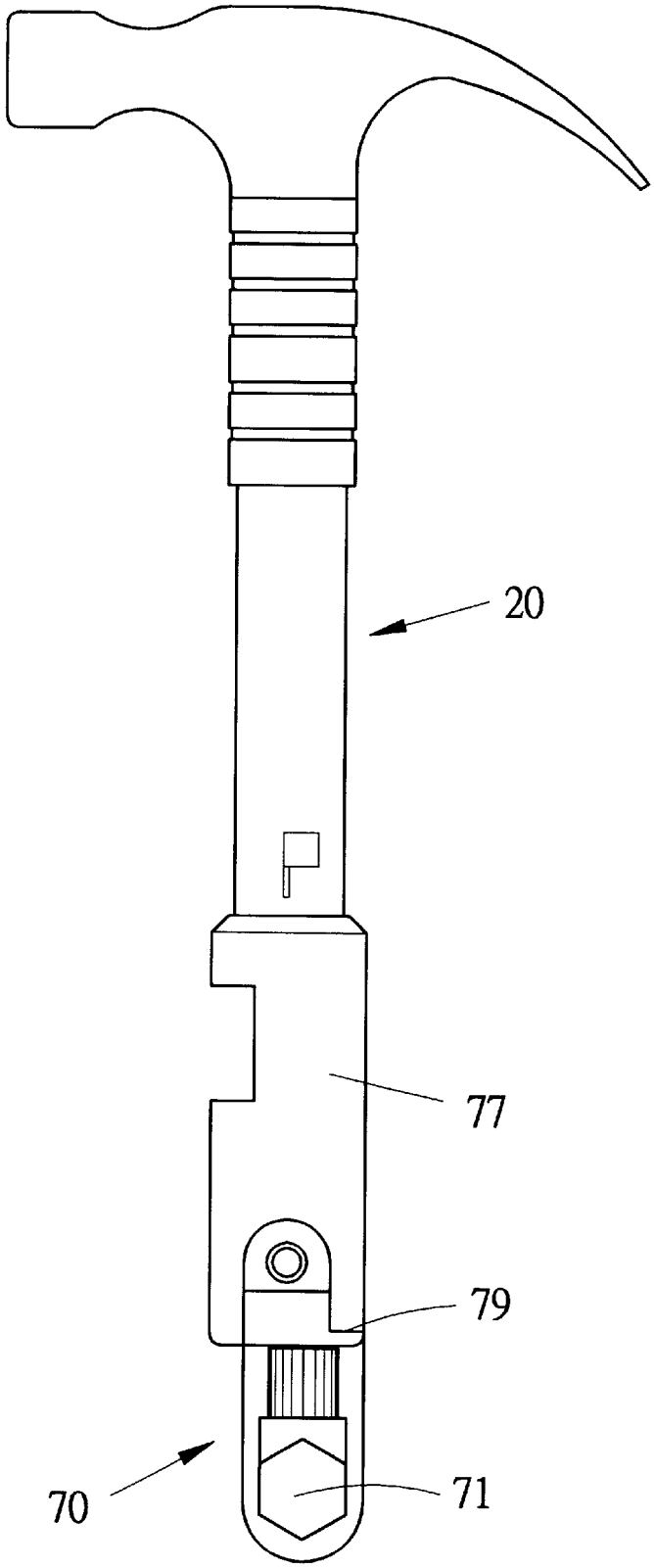
FIG. 10 shows that the nailing tool is alternatively used as a wrench.

Referring to FIGS. 4 and 10, the operator can turn the wrench member 70 out of a slot 78 of the sleeve member 77 (as shown in FIG. 9) and lean a step section 79 of the wrench member 70 against the bottom end of the stem body 20 to serve as a wrench. The opening 71 of the wrench member 70 can be fitted onto a nut or a bolt for wrenching the same.

Figure 11:
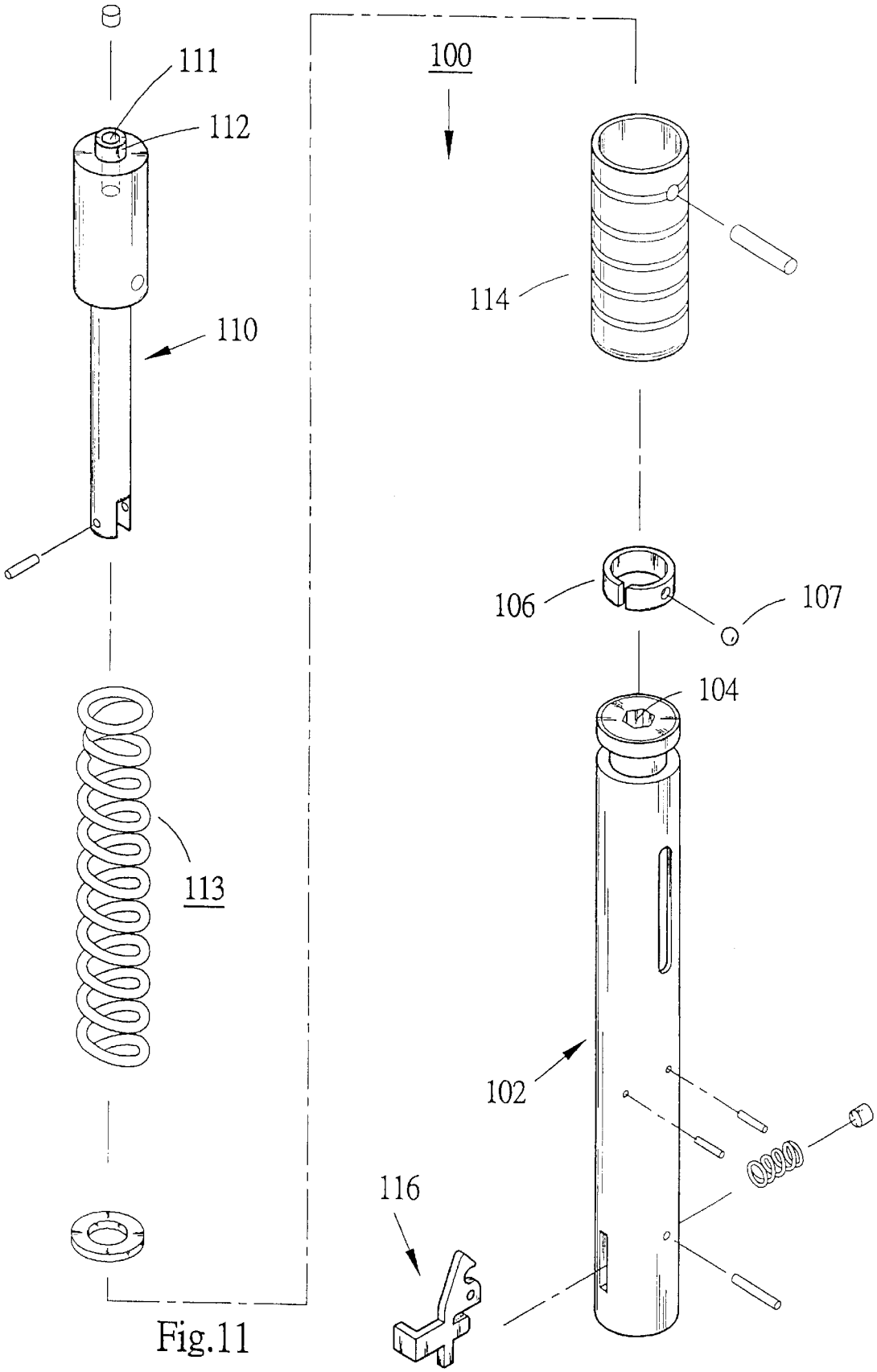
FIG. 11 is a perspective exploded view of another embodiment of the present invention.
Figure 12:
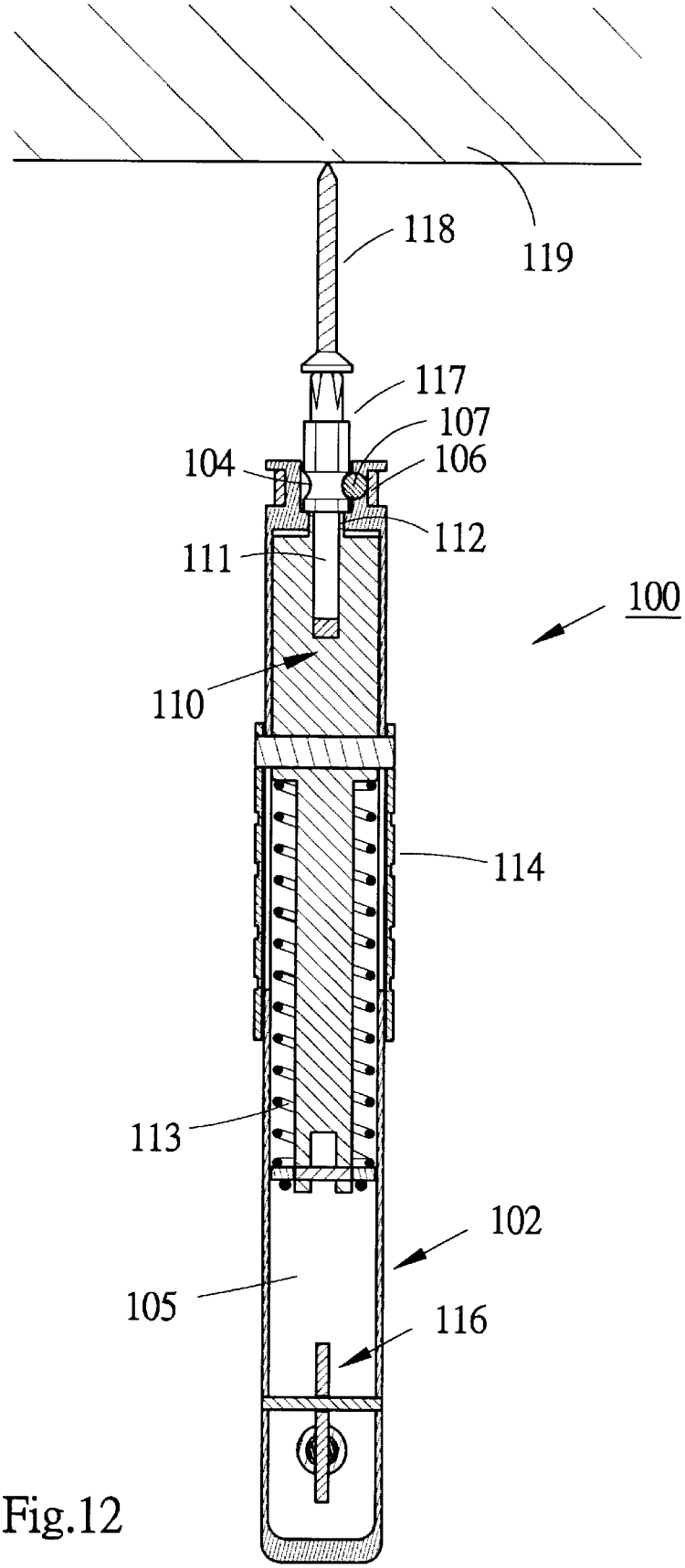
FIG. 12 is a longitudinal sectional view according to FIG. 11, showing that a self-tapping screw is to be started into a work piece.

FIGS. 11 and 12 show another embodiment of the present invention, in which the nailing tool 100 is not equipped with the head body and the wrench member of the first embodiment, while the remaining parts are substantially identical to those of the first embodiment. The second embodiment also includes a stem body 102, a striking member 110, a resilient member 113, a pull member 114 and a press button 116. A nail is loaded into the cavity 111 of the top end of the striking member 110 and nailed into the work piece as the first embodiment.

The top end of the stem body 102 is formed with a hexagonal socket 104 communicating with the tunnel 105. A driving member such as a screwdriver bit 117 is installed in the socket 104. A self-tapping screw 118 is engaged with the front end of the screwdriver bit 117. The screwdriver bit is retained by a second locating member 107 such as a steel ball. The locating member 107 is resiliently pushed by a resilient member 106 to locate the screwdriver bit in the socket.

In operation, the self-tapping screw 118 is held against a work piece 119. Then, as shown in FIGS. 6 and 7, the pull member 114 is pulled backward to latch the striking member 110 with the press button 116 at a position ready for striking. After the striking member is unlatched, a projecting section 112 of front end of the striking member 110 strikes the screwdriver bit 117. The striking force is transmitted to the self-tapping screw 118 to nail the tip thereof into the work piece 119. Thereafter, the screwdriver bit 117 can be screwed with the nailing tool 100 to screw the self-tapping screw 118 into the work piece.

Figure 13:
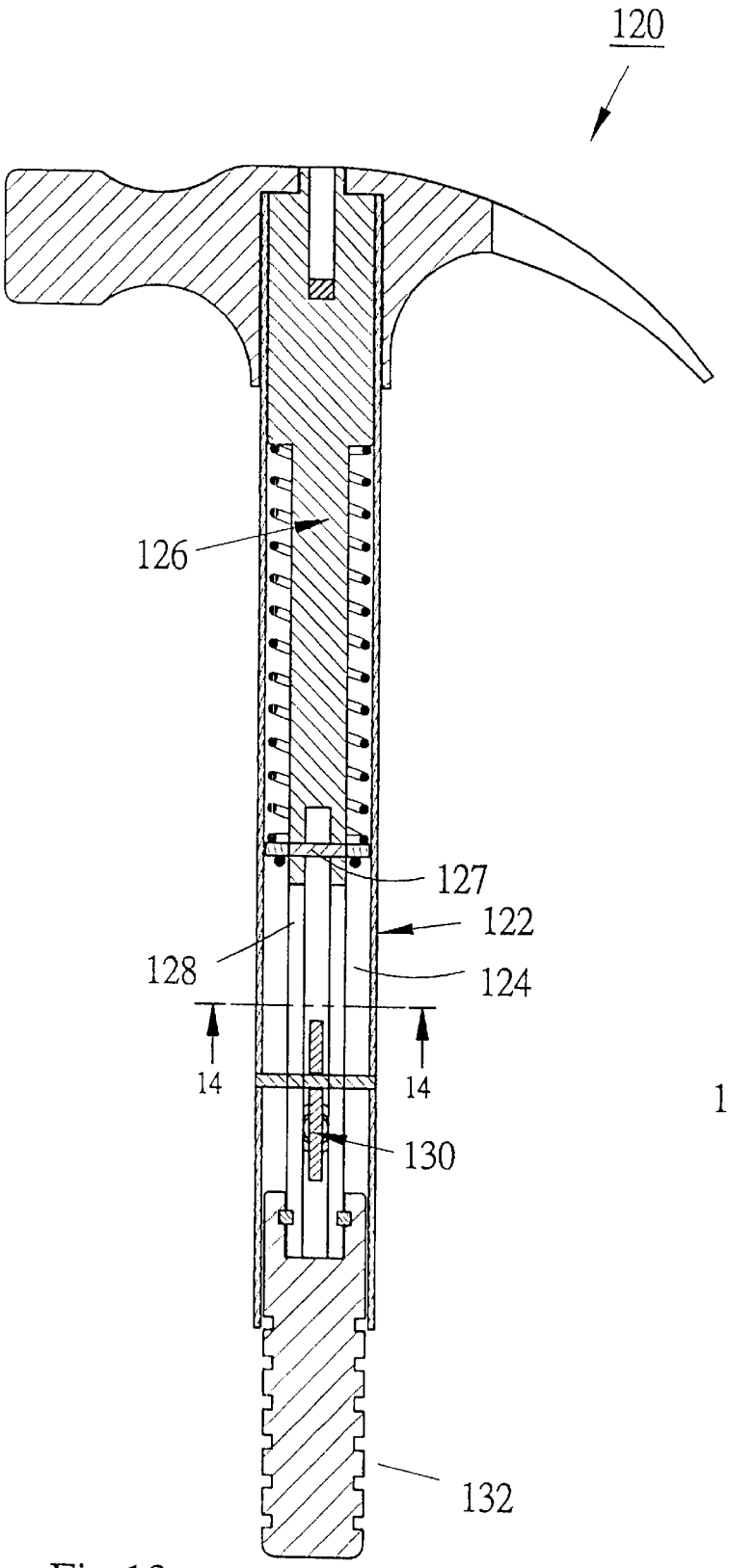
FIG. 13 is a longitudinal sectional view of still another embodiment of the present invention.
Figure 14:
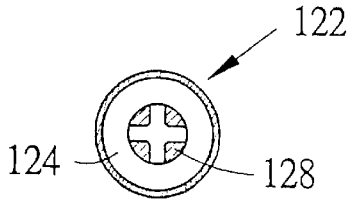
FIG. 14 is a sectional view taken along line 14—14 of FIG. 13.

FIGS. 13 and 14 show still another embodiment of the present invention, in which the structure of the nailing tool 120 is substantially identical to that of the first embodiment. The tunnel 124 of the stem body 122 passes through the bottom end thereof. The striking member 126 has a connecting section 128 downward extending from lower side of the hooking section 127. The connecting section 128 is composed of several elongated ribs. The bottom end of the connecting section extends through the press button 130 to the bottom end of the stem body 122. One end of the pull member 132 is connected with the bottom end of the connecting section 128, while the other end thereof protrudes out of the bottom end of the stem body for an operator's hand to hold.

In use, the operator holds and downward pulls the pull member 132. Via the connecting section 128, the striking member 126 is moved downward to latch the hooking section 127 with the press button 130. Accordingly, the striking member can strike a nail or a self-tapping screw into a work piece.

Figure 15:
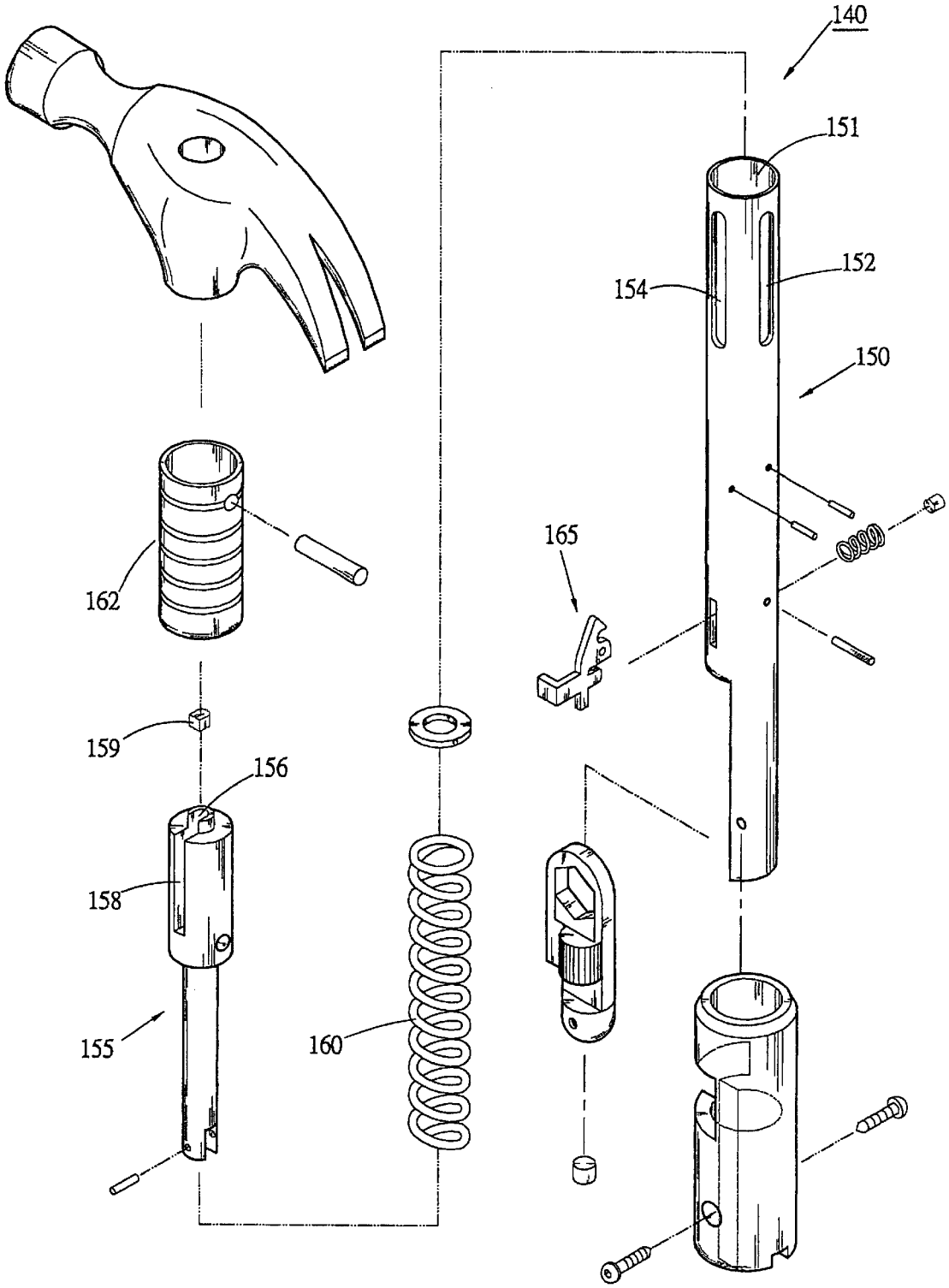
FIG. 15 is a perspective exploded view of still another embodiment of the present invention.
Figure 16:
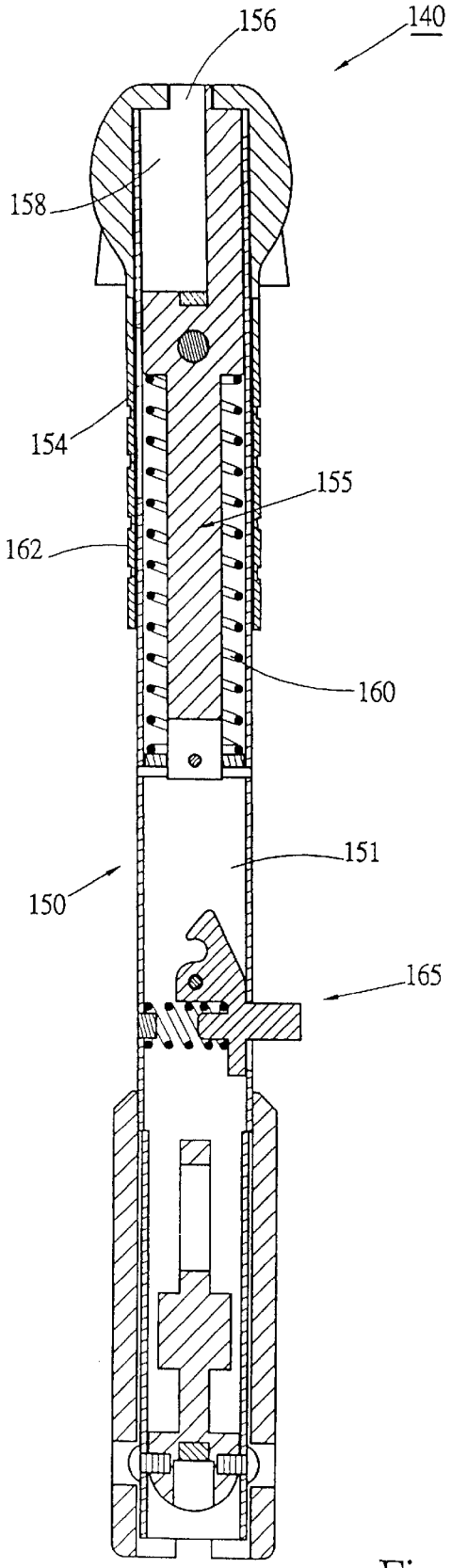
FIG. 16 is a longitudinal sectional assembled view of the embodiment of FIG. 15.

FIGS. 15 and 16 show still another embodiment of the present invention, in which the structure of the nailing tool 140 is substantially identical to that of the first embodiment. This embodiment also includes a stem body 150, a striking member 155, a resilient member 160, a pull member 162 and a press button 165. The difference resides in that in addition to two guide slots 152, the top end of the stem body 150 is further formed with a slot 154 communicating with the tunnel 151 of the stem body. The cavity 156 of the striking member 155 communicates with a lateral split 158 passing through the circumferential face of the striking member. When the striking member 155 is installed in the stem body 150, the lateral split 158 is radially directed to the slot 154.

Figure 17:
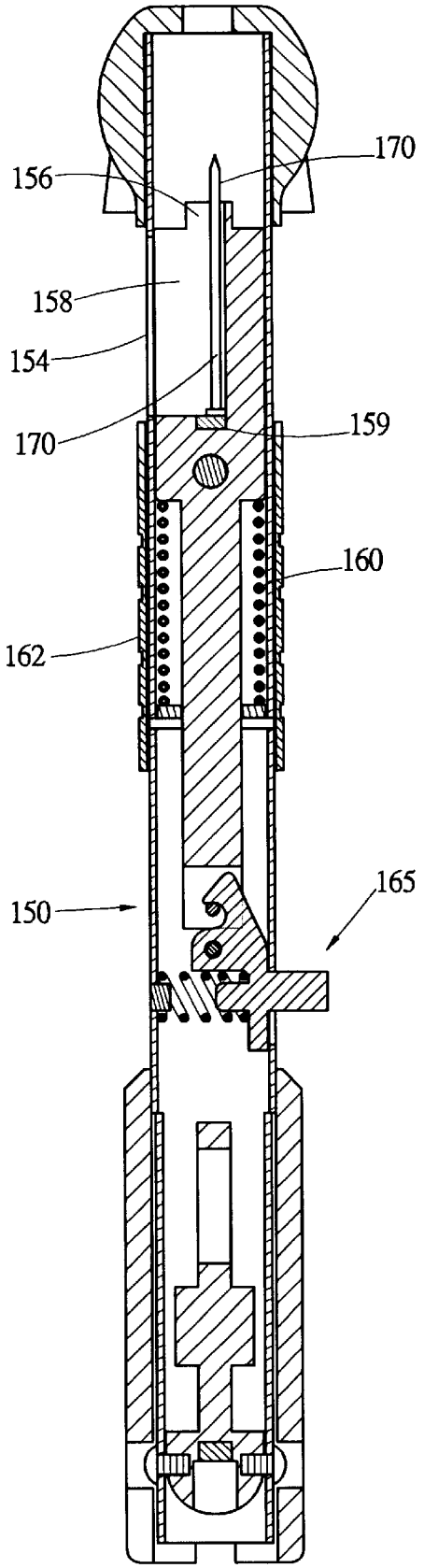
FIG. 17 is a view according to FIG. 16, showing that a nail is laterally loaded into the nailing tool.
Figure 18:
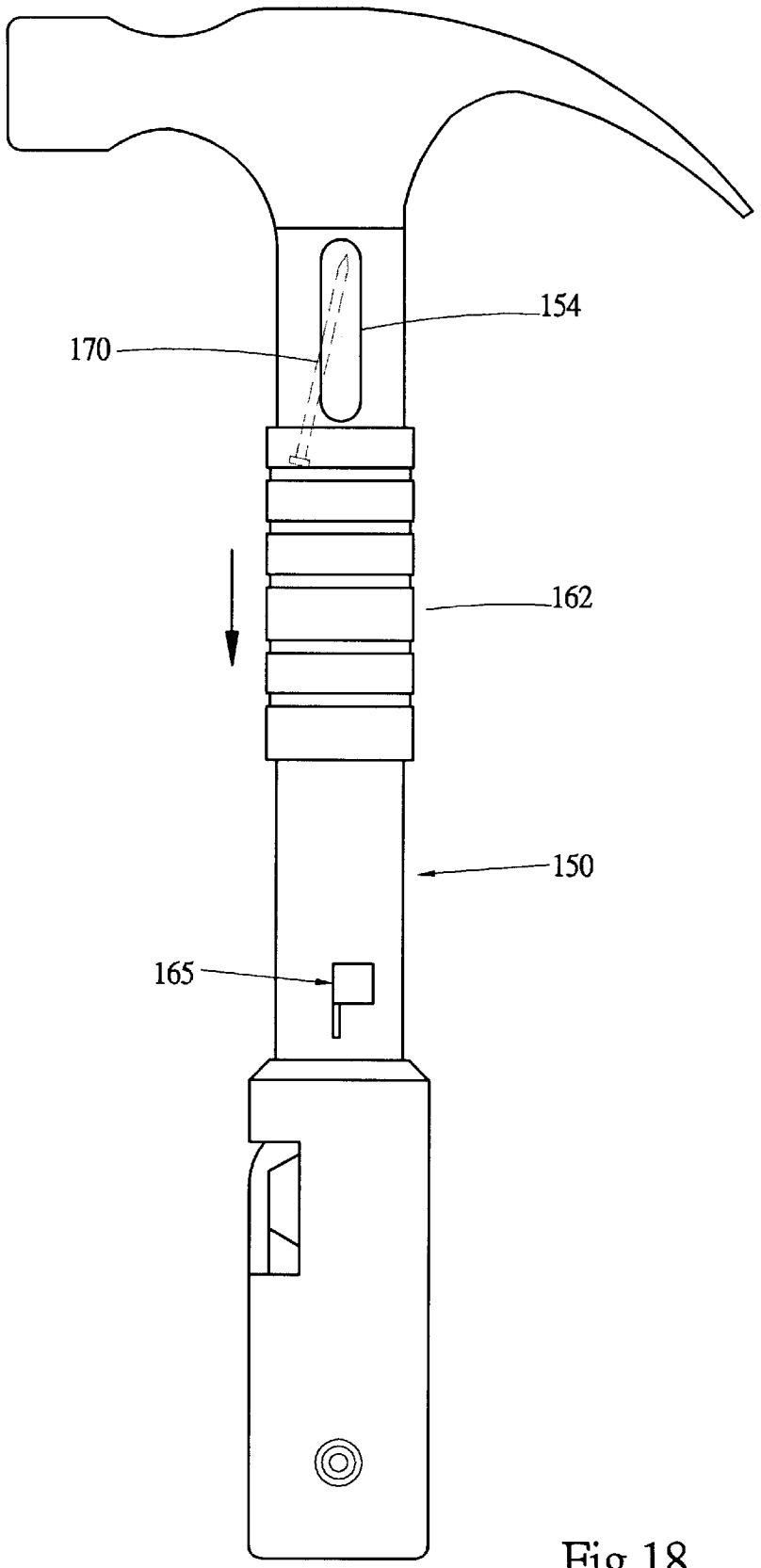
FIG. 18 is a side assembled view according to FIG. 15, showing that the nail is laterally loaded into the nailing tool.

When loaded, a nail not only can be placed into the top end of the stem body, but also can be laterally loaded thereinto as shown in FIG. 17. The pull member 162 and the striking member 155 are pulled downward to latch with the press button 165 at a position ready for striking. The lateral split 158 of the cavity 156 is aligned with the slot 154 and exposed to outer side. At this time, as shown in FIG. 18, the operator can obliquely load the nail 170 through the slot 154 into the cavity 156 to be located by the magnet 159. Accordingly, the striking member can strike the nail into a work piece.

In this embodiment, the slot 154 can be omitted. Alternatively, the lateral split 158 of the striking member 155 can be directed to one of the guide slots 152. When the pull member 162 and the striking member are positioned at a position ready for striking, the lateral split 158 is aligned with the guide slot 152, whereby the nail can be loaded through the guide slot 152 into the cavity 156.

The resilient members of the above embodiments for providing elastic energy for the striking member can be compression springs or extension springs.

According to the above arrangements, the nailing tool of the present invention enables an operator to previously nail a sharp connecting member such as a nail or a self-tapping screw into a work piece to facilitate succeeding work. Also, such arrangements protect the operator from being injured in operation.

The above embodiments are only used to illustrate the present invention, not intended to limit the scope thereof. Many modifications of the above embodiments can be made without departing from the spirit of the present invention.

What is claimed is:

1. Nailing tool capable of initially starting a connecting member with a tip, comprising:

a stem body having a top end and a bottom end formed with an internal axial tunnel;

a striking member having a top end and a bottom end, said to p end of the striking member being formed inwardly with a cavity in which a connecting member can be loaded, the striking member being axially slidably fitted in the tunnel of the stem body, wherein the cavity is exposed outside of the nailing tool through a top end of the tunnel;

a resilient member being disposed between the striking member and the stem body, whereby when not subject to external force, the resilient member resiliently keeps forcing the striking member toward a stop at the top end of the stem body;

a pull member connected with the striking member and positioned outside the stem body, whereby an operator's hand can operate the pull member to move the striking member toward the bottom end of the stem body and make the resilient member reserve an elastic energy; and a press button pivotally connected with the stem body, whereby when the striking member is moved toward the bottom end of the stem body, the press button latches the striking member and the striking member is positioned at a position ready for striking and when the press button is pressed, the striking member is unlatched from the press button and the striking member is resiliently moved toward the top end of the stem body;

wherein a striking force of the striking member drives a tip of the connecting member loaded into the cavity into a workpiece.

2. Nailing tool as claimed in claim 1, wherein the striking member has a hooking section formed on a predetermined portion of the striking member; the press button has a latch hook section and a press section, the press section positioned outside the stem body for an operator's hand to press, wherein when the striking member is moved toward the bottom end of the stem body, the latch hook section latches the hooking section of the striking member, and when the press section is pressed, the hooking section is unlatched from the latch hook section.

3. Nailing tool as claimed in claim 1, wherein at least one axial guide slot is formed on a circumference of the stem body which communicates with the tunnel, the pull member being a tube body fitted around the stem body and at least one pin member being transversely passed through the guide slot to connect the pull member and the striking member.

4. Nailing tool as claimed in claim 1, wherein the tunnel passes through the bottom end of the stem body, the bottom end of the striking member extending toward the bottom end of the stem body and the pull member being connected with the top end of the striking member.

5. Nailing tool as claimed in claim 2, wherein when the striking member has engaged the stop, the press button is disengaged from the hooking section.

6. Nailing tool as claimed in claim 2, wherein the press button is pivotally disposed in the stem body with the hooking section positioned inside the stem body and with the press section extending out of the stem body.

7. Nailing tool as claimed in claim 1, further comprising a head body fixed to the top end of the stem body with the cavity of the striking member being exposed outside of the nailing tool.

8. Nailing tool as claimed in claim 7, wherein the head body is formed with a through hole communicating with the tunnel, the cavity of the striking member being exposed outside of the nailing tool through the through hole.

9. Nailing tool as claimed in claim 1, wherein a locating member is disposed in the cavity for locating the connecting member in the cavity.

10. Nailing tool as claimed in claim 9, wherein the locating member is a magnet.

11. Nailing tool as claimed in claim 1, wherein the top end of the stem body is further formed with an axial socket communicating with the tunnel and aligned with the cavity, a driving member being disposed in the socket, the striking force of the striking member being transmitted to the driving member.

12. Nailing tool as claimed in claim 11, wherein the top end of the striking member has a projecting section projecting upward from a periphery of the cavity and extending into the socket.

13. Nailing tool as claimed in claim 11, further comprising a locating member disposed in the socket.

14. Nailing tool as claimed in claim 11, further comprising a head body fixed to the top end of the stem body with the socket exposed outside of the nailing tool.

15. Nailing tool as claimed in claim 1, further comprising a wrench member, one end of the wrench member being formed with an opening for wrenching a nut, the wrench member being disposed at the bottom end of the stem body.

16. Nailing tool as claimed in claim 15, wherein another end of the wrench member is formed with a socket.

17. Nailing tool as claimed in claim 3, wherein the cavity of the striking member communicates with a lateral split passing through a circumferential face of the striking member, the lateral split being radially directed to a guide slot, whereby when the striking member is positioned at a position ready for striking, the lateral split is aligned with the guide slot.

18. Nailing tool as claimed in claim 1, wherein the circumference of the stem body is further formed with a slot communicating with the tunnel, the cavity of the striking member communicating with a lateral split passing through the circumferential face of the striking member, the lateral split being radially directed to the slot, whereby when the striking member is positioned at a position ready for striking, the lateral split is aligned with the slot.

19. Nailing tool as claimed in claim 1, wherein the resilient member is fitted around the striking member, one end of the resilient member abutting against the striking member, while another end thereof abuts against a retaining section.

20. Nailing tool as claimed in claim 3, wherein the pin member of the striking member abuts against a top end of the guide slot which serves as the stop for the striking member.

21. Nailing tool as claimed in claim 7, wherein the top end of the striking member abuts against the head body serving as a stop for the striking member.

* * * * *